US007999480B2

(12) United States Patent
Hong et al.

(10) Patent No.: US 7,999,480 B2
(45) Date of Patent: Aug. 16, 2011

(54) CONTROL CIRCUIT AND FLASH SYSTEM USING SAME

(75) Inventors: Yu-Jiang Hong, Guangdong (CN); Wei Lin, Guangdong (CN)

(73) Assignees: Premier Image Technology(China) Ltd., Foshan, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 326 days.

(21) Appl. No.: 12/435,364

(22) Filed: May 4, 2009

(65) Prior Publication Data

US 2010/0102740 A1 Apr. 29, 2010

(30) Foreign Application Priority Data

Oct. 27, 2008 (CN) ..... 2008 1 0305227

(51) Int. Cl.
*H05B 37/00* (2006.01)

(52) U.S. Cl. ..... 315/200 A; 315/241 P

(58) Field of Classification Search ..... 315/200 A, 315/241 P, 242, 241 S, 244, 245, 360, 169.3
See application file for complete search history.

(56) References Cited

U.S. PATENT DOCUMENTS

| | | | | |
|---|---|---|---|---|
| 5,187,410 | A * | 2/1993 | Shimizu et al. | 315/241 P |
| 5,264,895 | A * | 11/1993 | Takahashi et al. | 396/157 |
| 6,066,926 | A * | 5/2000 | Yamada | 315/241 P |
| 7,522,831 | B2 * | 4/2009 | Feng et al. | 396/205 |
| 7,633,234 | B2 * | 12/2009 | Drader et al. | 315/200 A |
| 2002/0047626 | A1 * | 4/2002 | Odaka et al. | 315/291 |
| 2002/0171372 | A1 * | 11/2002 | Motomura et al. | 315/200 A |
| 2006/0226789 | A1 * | 10/2006 | Maishima | 315/241 P |

* cited by examiner

*Primary Examiner* — Don Le
(74) *Attorney, Agent, or Firm* — Zhigang Ma

(57) ABSTRACT

A control circuit is configured to control the charge and discharge of a flash unit. The flash unit includes an anode, a cathode, and a trigger electrode. The control circuit includes a charging circuit and a triggering circuit. One terminal of the charging circuit is coupled to a charging terminal and another terminal is coupled to the anode and the cathode. One terminal of the triggering circuit is coupled to a triggering terminal, another terminal is couple to the trigger electrode. The charging circuit includes a first capacitor coupled to the cathode and a second capacitor coupled to the anode. When the charging terminal receives a charging voltage and the triggering terminal receives a high-level voltage, three times charging voltage is formed between the anode and the cathode; then the flash unit generates a flash.

10 Claims, 1 Drawing Sheet

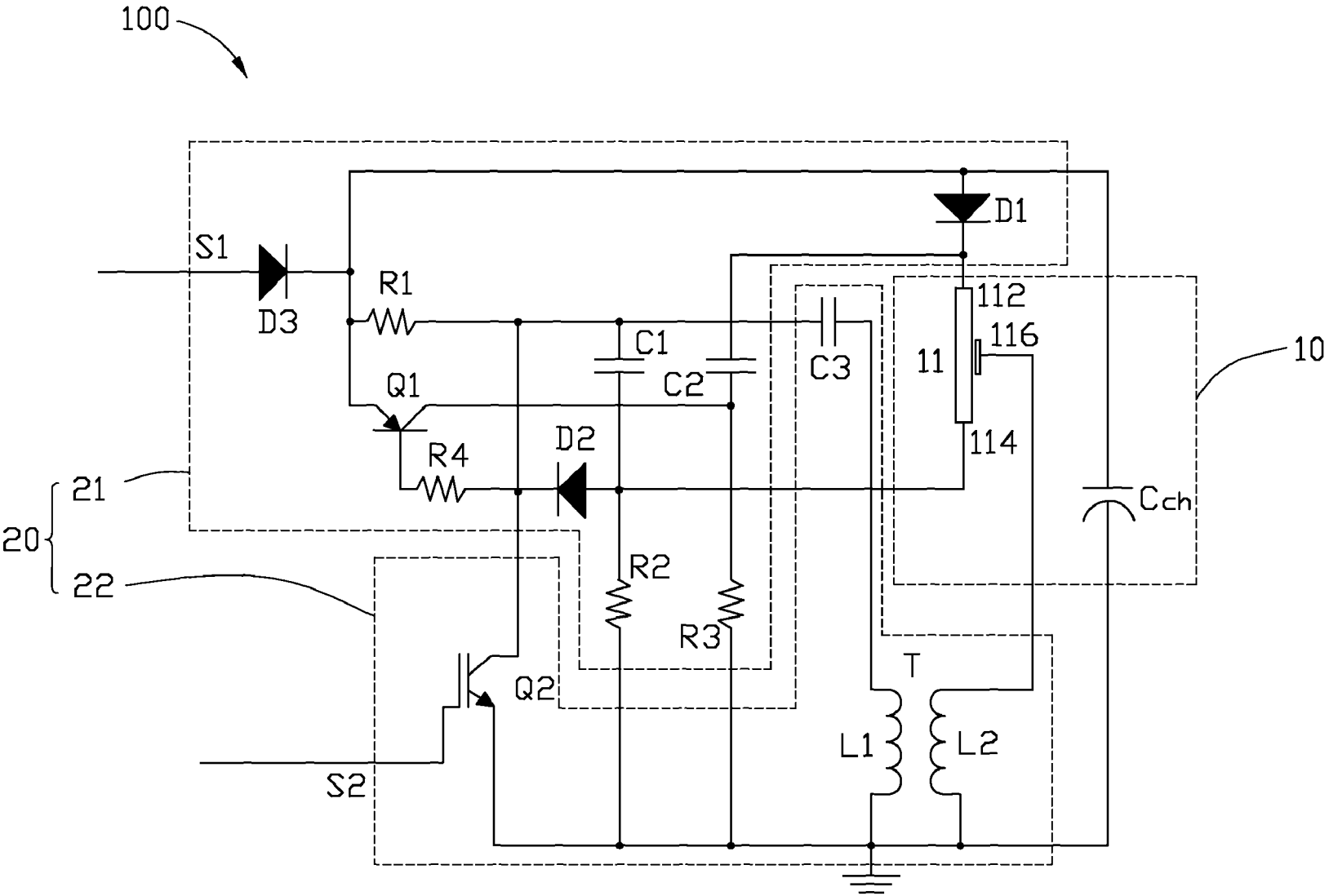
10
Cch
D1
112
116
114
11
L2
T
L1
C3
C2
C1
R3
R2
D2
Q2
R4
R1
Q1
D3
S1
S2
100
21
22
20

CONTROL CIRCUIT AND FLASH SYSTEM USING SAME

BACKGROUND

1. Technical Field

The present disclosure relates to circuits and, particularly, to a control circuit and a flash system using the same.

2. Description of Related Art

A flash system typically includes a flash unit and a control circuit. The flash unit is an electric glow discharge device designed to produce extremely intense, incoherent, momentary bright light. The control circuit is employed to provide a high trigger voltage to the flash unit to generate the flash. The intensity of the flash can be increased by increasing the trigger voltage. However, if the trigger voltage is too high, the flash unit may be damaged, which may also be very dangerous to users.

What is needed, therefore, is a control circuit and a flash system using the same which can overcome the above-described problem.

BRIEF DESCRIPTION OF THE DRAWINGS

The FIGURE is a schematic circuit diagram of a flash system in accordance with an exemplary embodiment.

DETAILED DESCRIPTION

Embodiments of the present control circuit and the flash system using the same will now be described in detail with reference to the drawing.

Referring to the FIGURE, one embodiment of a flash system 100 includes a flash unit 10 and a control circuit 20. The control circuit 20 is used to control the flash unit 10 to charge and discharge.

The flash unit 10 includes a flash tube 11 and a charging capacitor $C_{ch}$. The flash tube 11 is filled with a noble gas, e.g., xenon, and includes an anode 112, a cathode 114, and a triggering electrode 116. The noble gas can be ionized by applying high voltage to the triggering electrode 116. The anode 112 and the cathode 114 can carry electrical current through the fully ionized noble gas and produce a bright light.

The charging capacitor $C_{ch}$ is configured for charging the flash tube 11. The charging capacitor $C_{ch}$ includes a first terminal and a second terminal. The second terminal is grounded.

The control circuit 20 includes a charging circuit 21 and a triggering circuit 22. The charging circuit 21 is coupled to the anode 112 and cathode 114 of the flash tube 11. The triggering circuit 22 is coupled to the trigger electrode 116.

The charging circuit 21 includes a first diode D1, a second diode D2, a third diode D3, a first capacitor C1, a second capacitor C2, a first switching element Q1, a first resistor R1, a second resistor R2, a third resistor R3, and a fourth resistor R4.

The first diode D1 includes an anode and a cathode. The anode is coupled to the first terminal of the charging capacitor $C_{ch}$. The cathode of the first diode D1 is coupled to the anode 112 of the flash tube 11.

The first resistor R1 includes a first terminal and a second terminal. The first terminal is coupled to the anode of the first diode D1.

The first capacitor C1 includes a first terminal and a second terminal. The first terminal is coupled to the second terminal of the first resistor R1.

The second resistor R2 includes a first terminal and a second terminal. The first terminal is coupled to the second terminal of the C1. The second terminal is grounded.

The second capacitor C2 includes a first terminal and a second terminal. The first terminal is coupled to the cathode of the first diode D1.

The third resistor R3 includes a first terminal and a second terminal. The first terminal is coupled to the second terminal of the second terminal of the second capacitor C2. The second terminal is grounded.

The first switching element Q1 includes a first terminal, a second terminal, and a control terminal. The control terminal is used to control the connection and disconnection between the first terminal and the second terminal. The first terminal is coupled to the anode of the first diode D1. The second terminal is coupled to the second terminal of the second capacitor C2. In this embodiment, the first switching element Q1 is a PNP-type crystal triode, wherein the first terminal is the emitter, the second terminal is the collector, and the control terminal is the base.

The fourth resistor R4 includes a first terminal and a second terminal. The first terminal is coupled to the control terminal of the first switching element Q1. The second terminal of the fourth resistor R4 is coupled to the second terminal of the first resistor R1. In this embodiment, the fourth resistor R4 can be omitted.

The second diode D2 includes an anode and a cathode. The anode of the second diode D2 is coupled to the cathode 114 of the flash tube 11. The cathode of the second diode D2 is coupled to the second terminal of the fourth resistor R4.

The third diode D3 includes an anode and a cathode. The anode of the second diode D2 is coupled to a charging terminal S1. The cathode of the second diode D2 is coupled to the anode of the flash diode D1. In this embodiment, the second diode D2 can be omitted.

The triggering circuit 22 includes a second switching element Q2, a third capacitor C3, and a transformer T.

The second switching element Q2 includes a first terminal, a second terminal, and a control terminal. The control terminal is used to control the connection and disconnection between the first terminal and the second terminal. The first terminal is grounded. The second terminal is coupled to the anode of the second diode D2. The control terminal is coupled to a trigger terminal S2. In this embodiment, the second switching element Q2 is a p-channel insulated gate bipolar transistor (p-IGBT), wherein the first terminal is the emitter, the second terminal is the collector, and the control terminal is the gate.

The third capacitor C3 includes a first terminal and a second terminal. The first terminal is coupled to the second terminal of the first resistor R1.

The transformer T includes a primary winding L1 with N1 turns and a secondary winding L2 with N2 turns. The ratio of turns N2 in the secondary winding to the turns N1 in the primary winding L1 is N2/N1=20. The primary winding L1 includes a first terminal and a second terminal; the first terminal is coupled to the second terminal of the third capacitor C3, and the second terminal is grounded. The secondary winding L2 includes a first terminal and a second terminal; the first terminal is coupled to the triggering electrode 116 of the flash tube 11, and the second terminal is grounded.

In operation, usually, when a camera having the flash system 100 is powered on, a charging voltage V1 is input to the charging terminal S1. The third diode D3 and the charging capacitor $C_{ch}$ form a loop. The charging capacitor $C_{ch}$ is charged. Also, the third diode D3, the first resistor R1, the first capacitor C1, and a second resistor R2 form a loop. The first capacitor C1 is charged. Furthermore, the third diode D3, the first diode D1, the second capacitor C2, and the third resistor R3 form a loop. The second capacitor C2 is charged. After charging, the voltage of the first terminal of the charging capacitor $C_{ch}$, the first terminal of the first capacitor C1, and the first terminal of the second capacitor C2 is V1.

When flash is needed, a user can trigger the flash system by, for example, depressing a shutter button (not shown). Then, a high-level voltage greater than the turn-on voltage of the second switching element Q2 is applied to the trigger terminal S2. The first terminal is electrically connected to the second terminal of the second switching element Q2. As the first terminal of the second switching element Q2 is grounded, the voltage of second terminal changes to about 0 volts. The first terminal of the first capacitor C1 is accordingly pulled down to about 0 volts. As a result, the second terminal changes to −V1. The voltage across the second resistor R4 changes to about 0 volts, the control terminal accordingly changes to about 0 volts. Thus the first terminal is electrically connected to the second terminal of the first switching element Q1. The second terminal of the second capacitor C2 changes to V1, and the first terminal changes to 2*V1.

As the second terminal of the first capacitor C1 is coupled to the cathode 114 of the flash tube 11, and the first terminal of the second capacitor C2 is coupled to the anode 112 of the flash tube 11. As a result, the voltage drop between the anode 112 and cathode 114 is 2*V1−(−V1)=3*V1.

The transformer T and the third capacitor C3 form a clapp circuit, and the transformer T changes the charging voltage V1 to the 20*V1. The trigger voltage of the triggering electrode 116 changes to 20*V1. With the trigger voltage at 20*V1 applied to the triggering electrode 116 and the voltage drop of 3*V1 volts across the anode 112 and cathode 114, the flash tube 11 discharges. The charging capacitor $C_{ch}$ then charges the flash tube 11.

It will be understood that the above particular embodiments and methods are shown and described by way of illustration only. The principles and the features of the present invention may be employed in various and numerous embodiment thereof without departing from the scope of the invention as claimed. The above-described embodiments illustrate the scope of the invention but do not restrict the scope of the invention.

What is claimed is:

1. A control circuit configured to control the charge and discharge of a flash unit, comprising:

a charging circuit coupled to a charging terminal, comprising:

a first diode comprising an anode coupled to the charging terminal and a cathode coupled to the flash unit;

a first resistor comprising a first terminal coupled to the anode of the first diode and a second terminal;

a first capacitor comprising a first terminal coupled to the second terminal of the first resistor and a second terminal;

a second resistor comprising a first terminal coupled to the second terminal of the first capacitor and a second terminal being ground;

a second capacitor comprising a first terminal coupled to the cathode of the first diode and a second terminal;

a third resistor comprising a first terminal coupled to the second terminal of the second capacitor and a second terminal being ground;

a first switching element comprising a first terminal coupled to the anode of the first diode, a second terminal coupled to the second terminal of the second capacitor, and a control terminal; and a second diode comprising an anode coupled to the flash unit and a cathode coupled to the control terminal of the first switching element; and a triggering circuit coupled to a trigger terminal, comprising:

a second switching element comprising a first terminal being grounded, a second terminal coupled to cathode of the second diode and the second terminal of the first resistor, and a control terminal coupled to the trigger terminal;

a third capacitor comprising a first terminal coupled to the second terminal of the first resistor and a second terminal; and a transformer comprising a primary winding coupled to the second terminal of the third capacitor and a secondary winding coupled to the flash unit.

2. The control circuit as claimed in claim 1, further comprising a third diode, the third diode comprising an anode coupled to the charging terminal and a cathode coupled to the anode of the first diode.

3. The control circuit as claimed in claim 1, further comprising a fourth resistor, the fourth resistor comprising a first terminal coupled to the control terminal of the first switching element and second terminal coupled to the cathode of the second diode.

4. The control circuit as claimed in claim 1, wherein the first switching element is a PNP-type crystal triode, wherein the first terminal is the emitter, the second terminal is the collector, and the control terminal is the base.

5. The control circuit as claimed in claim 1, wherein the second switching element is a p-channel insulated gate bipolar transistor (p-IGBT), wherein the first terminal is the emitter, the second terminal is the collector, and the control terminal is the gate.

6. A flash system comprising:

a flash unit comprising:

a flash tube comprising an anode, a cathode, and a triggering electrode;

a charging capacitor comprising a first terminal be grounded and a second terminal coupled to the anode of the flash tube;

a control circuit comprising:

a charging circuit coupled to a charging terminal, comprising:

a first diode comprising an anode coupled to the charging terminal and a cathode coupled to the anode of the flash tube;

a first resistor comprising a first terminal coupled to the anode of the first diode and a second terminal;

a first capacitor comprising a first terminal coupled to the second terminal of the first resistor and a second terminal;

a second resistor comprising a first terminal coupled to the second terminal of the first capacitor and a second terminal being ground;

a second capacitor comprising a first terminal coupled to the cathode of the first diode and a second terminal;

a third resistor comprising a first terminal coupled to the second terminal of the second capacitor and a second terminal being ground;

a first switching element comprising a first terminal coupled to the anode of the first diode, a second terminal coupled to the second terminal of the second capacitor, and a control terminal; and a second diode comprising an anode coupled to the cathode of the flash tube and the cathode coupled to the control terminal of the first switching element; and a triggering circuit coupled to a trigger terminal, comprising:

a second switching element comprising a first terminal being grounded, a second terminal coupled to cathode of the second diode and the second terminal of the first resistor, and a control terminal coupled to the trigger terminal;

a third capacitor comprising a first terminal coupled to the second terminal of the first resistor and a second terminal; and a transformer comprising a primary winding coupled to the second terminal of the third capacitor and a secondary winding coupled to the trigger terminal of the flash tube.

7. The flash system as claimed in claim 6, further comprising a third diode, the third diode comprising an anode coupled to the charging terminal and a cathode coupled to the anode of the first diode.

8. The flash system as claimed in claim 6, further comprising a fourth resistor, the fourth resistor comprising a first terminal coupled to the control terminal of the first switching element and second terminal coupled to the cathode of the second diode.

9. The flash system as claimed in claim 6, wherein the first switching element is a PNP-type crystal triode, wherein the first terminal is the emitter, the second terminal is the collector, and the control terminal is the base.

10. The flash system as claimed in claim 6, wherein the second switching element is a p-channel insulated gate bipolar transistor (p-IGBT), wherein the first terminal is the emitter, the second terminal is the collector, and the control terminal is the gate.

* * * * *